US008212135B1

(12) United States Patent
Sharifi et al.

(10) Patent No.: US 8,212,135 B1
(45) Date of Patent: Jul. 3, 2012

(54) SYSTEMS AND METHODS FOR FACILITATING HIGHER CONFIDENCE MATCHING BY A COMPUTER-BASED MELODY MATCHING SYSTEM

(75) Inventors: Matthew Sharifi, Zurich (CH); David Ross, San Jose, CA (US); Gheorghe Postelnicu, Zurich (CH); Yaniv Bernstein, Zurich (CH); Jay Michael Ponte, Mountain View, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/276,566

(22) Filed: Oct. 19, 2011

(51) Int. Cl.
*A63H 5/00* (2006.01)
*G04B 13/00* (2006.01)
*G10H 7/00* (2006.01)

(52) U.S. Cl. ..... 84/609

(58) Field of Classification Search ..... 84/609
See application file for complete search history.

(56) References Cited

U.S. PATENT DOCUMENTS 6,546,388 B1 * 4/2003 Edlund et al. ..... 1/1
7,340,455 B2 * 3/2008 Platt et al. ..... 1/1
7,546,288 B2 * 6/2009 Springer et al. ..... 1/1
7,571,183 B2 * 8/2009 Renshaw et al. ..... 1/1
2003/0061490 A1 * 3/2003 Abajian ..... 713/176
2003/0120654 A1 * 6/2003 Edlund et al. ..... 707/7
2003/0191764 A1 * 10/2003 Richards ..... 707/100
2004/0267693 A1 * 12/2004 Lowe et al. ..... 707/1
2005/0177568 A1 * 8/2005 Diamond et al. ..... 707/5
2006/0004711 A1 * 1/2006 Naam ..... 707/3
2007/0266021 A1 * 11/2007 Aravamudan et al. ..... 707/5
2008/0126323 A1 * 5/2008 Bogdanov ..... 707/3
2008/0148924 A1 * 6/2008 Tsui et al. ..... 84/618
2009/0112831 A1 * 4/2009 Gupta et al. ..... 707/4

* cited by examiner

*Primary Examiner* — Jeffrey Donels
(74) *Attorney, Agent, or Firm* — Turocy & Watson, LLP

(57) ABSTRACT

Systems and methods for facilitating higher confidence matches are provided. In one embodiment, a system includes a memory that stores computer executable components, and a microprocessor that executes the computer executable components stored in the memory. The components can include a metadata matching component that determines a metadata match level between metadata of a plurality of files, and a thresholding component. The thresholding component may compare a metadata threshold with the metadata match level and output a signal configured to cause a decrease in a melody matching strength threshold from a first value to a second value based at least on the metadata match level being greater than the metadata threshold.

18 Claims, 14 Drawing Sheets

SYSTEMS AND METHODS FOR FACILITATING HIGHER CONFIDENCE MATCHING BY A COMPUTER-BASED MELODY MATCHING SYSTEM

TECHNICAL FIELD

This disclosure generally relates to facilitation of higher confidence melody matching by a computer-based melody matching system.

BACKGROUND

In today's world, multimedia is prolific and users can experience multimedia in a number of ways. Of particular popularity among users, especially those seeking professional singing careers, is the ability to create an audio or a combination video and audio recording of oneself performing (e.g., singing or playing) a composition previously-recorded by a professional artist. Users then post the performance online for other users, e.g., a coach or professional contact, to view. Systems facilitating posting of such content typically match the composition performed by the user with a composition previously recorded by the professional artist. Such matching can facilitate proper attribution to content owners for example.

One type of matching is based on matching the melodies in a performance with the melodies in a previously recorded composition. Systems of such type are typically referred to as melody matching systems. In some cases, matching is particularly challenging due to differences in melodies in the compositions being analyzed. For example, in some cases, the melodies in the performance may be somewhat distinct from those in the previously-recorded composition. Distinctions can arise due to skill level of a user performing a composition, extensive improvisation by the user or for any number of other reasons. False positives occur when the system erroneously determines that the user performance and the previously-recorded composition are the same composition. False positives decrease the reliability of melody matching systems and, as such, are ideally minimized. Accordingly, systems and methods that reduce false positives, thereby enhancing the confidence of melody matching systems are desirable.

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its purpose is to present some concepts of one or more embodiments in a simplified form as a prelude to the more detailed description that is presented later.

In one or more embodiments, the disclosed subject matter relates to a melody matching system. The computer-implemented system can include a metadata matching component configured to determine a metadata match level between metadata of a plurality of files, and a thresholding component. The thresholding component can be configured to: compare the metadata match level with a metadata threshold; and output a signal configured to cause a decrease in a melody matching strength threshold from a first value to a second value based at least on the metadata match level being greater than the metadata threshold.

In another embodiment, the disclosed subject matter also relates to a method of facilitating high-confidence melody matching by a computer-based melody matching system. The method can include employing a microprocessor to execute computer executable components stored within a memory to perform various acts. The acts can include: determining a first metadata match level between metadata of video channels; and comparing one or more metadata match levels with a metadata threshold. The one or more metadata match levels can include the first metadata match level. The method can also include decreasing a melody matching strength threshold from a first value to a second value based on at least one of the one or more metadata match levels being greater than the metadata threshold.

In another embodiment, the disclosed subject matter also relates to another method of facilitating high-confidence melody matching by a computer-based melody matching system. The method can include employing a microprocessor to execute computer executable components stored within a memory to perform various acts. The acts can include: receiving a media file embodying a user performance of a composition; and comparing metadata associated with the media file with metadata associated with a media file embodying a second performance. The method can also include: determining a metadata match level between the metadata associated with the media file and the metadata associated with the media file embodying the second performance; and determining whether the metadata match level is greater than a metadata threshold. Additionally, the method can also include decreasing a melody matching strength threshold from a first value a second value based, at least, on the metadata match level being greater than the metadata threshold. Further, the method can include classifying the media file embodying the user performance as a valid match with media file embodying the second performance based, at least, on strength of matching melodies between the media files being greater than the melody matching strength threshold. In some embodiments, the method can include maintaining the melody matching strength threshold at the first value based, at least, on the metadata match level being less than the metadata threshold.

Toward the accomplishment of the foregoing and related ends, the one or more embodiments include the features hereinafter fully described and particularly pointed out in the claims. The following description and the annexed drawings set forth herein detail certain illustrative aspects of the one or more embodiments. These aspects are indicative, however, of but a few of the various ways in which the principles of various embodiments can be employed, and the described embodiments are intended to include all such aspects and their equivalents.

DETAILED DESCRIPTION

Figure 1:
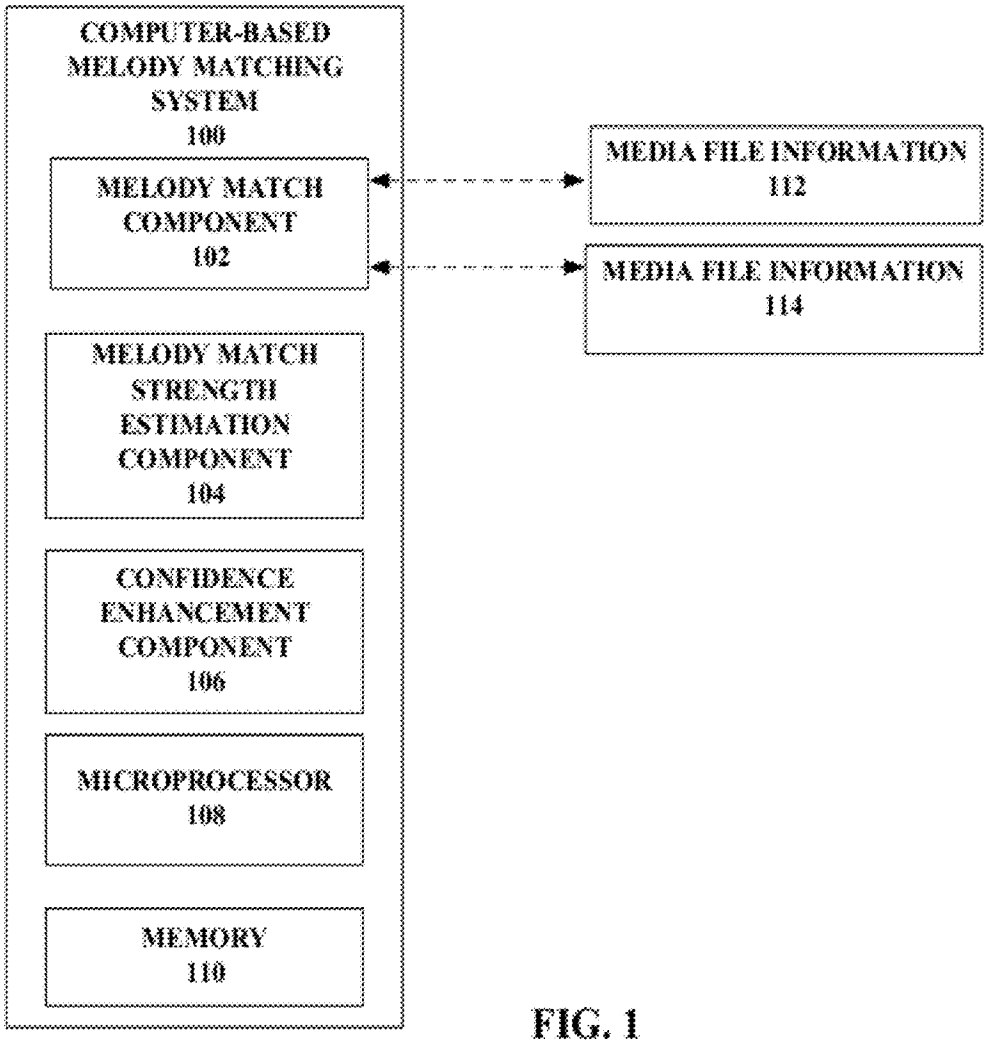
FIG. 1 is an illustration of a block diagram of an exemplary non-limiting computer-based melody matching system configured for higher confidence melody matching.

Various embodiments are now described with reference to the drawings, wherein like reference numerals are used to refer to like elements throughout. In the following description, for purposes of explanation, numerous specific details are set forth in order to provide a more thorough understanding of one or more embodiments. It is be evident, however, that such embodiments can be practiced without these specific details. In other instances, structures and devices are shown in block diagram form in order to facilitate describing one or more embodiments.

Systems and methods disclosed herein relate to high-confidence melody matching. In particular, melody-based matches are made between user-submitted files on which users are performing compositions, and files embodying professional renditions of the compositions, by professional artists. The melody-based matches can be assigned an associated melody matching strength, and can be deemed to be valid matches if the associated melody matching strength of a particular match is greater than a determined threshold. In some embodiments, a valid match is deemed to exist if the associated melody matching strength of the particular match is equal to the determined threshold. The threshold is determined based on a desire to yield a minimum number of false positives (or to yield a desired precision) for the melody-matching system. To enhance the number of matches deemed valid, while maintaining the desired system precision, metadata of the user-submitted files and the professional files can be compared for similarity. As such, the metadata can be an independent indicator dictating a level of confidence in the melody-based match based on the level of match between the title or artist metadata in the two files. The level of match between the metadata can be compared to a metadata threshold. Further, the melody matching strength threshold can be reduced if the metadata match level of the metadata is above the metadata threshold. The reduction from the first value of the melody matching strength threshold to the second value can be according to a continuous function or a step function, in various embodiments.

Because the melody matching strength threshold can be reduced from a first value to a second value, the systems and methods described herein can provide an increased number of matches deemed valid, while maintaining a desired precision. Thus, metadata information can be employed herein to provide higher confidence melody matching. In other embodiments, similar to metadata information, video channel information can be evaluated, and the melody matching strength threshold adjusted, e.g., to maintain a desired melody-matching precision level.

Turning now to the drawings, FIG. 1 is an illustration of a block diagram of an exemplary non-limiting computer-based melody matching system configured for higher confidence melody matching. In various embodiments, the computer-based melody matching system 100 can be employed in systems that perform fingerprinting of music and/or video works.

The computer-based melody matching system 100 can include a melody match component 102, a melody match strength estimation component 104, a confidence enhancement component 106, a microprocessor 108 and a memory 110. The components can be electrically and/or communicatively coupled to one another to perform the functions of the computer-based melody matching system 100.

The computer-based melody matching system 100 can receive new media file information 112, 114 and/or process previously-stored media file information 112, 114 for performing melody matching and confidence enhancement of melody matches. In various embodiments, the media file information 112 can include audio or a combination of audio and video from a user. For example, the media file information 112 can be received from a user and can include audio or a combination of video and audio of the user performing a composition.

The media file information 112 can also include metadata (not shown) describing the composition. By way of example, but not limitation, the metadata can describe the title of the composition, the title of the media file and/or the name of a professional artist that also performs the composition. For example, if a user performs the composition, "Georgia on My Mind," the official state song of Georgia made famous by a professional recording by Ray Charles, the media file information 112 can be the composition performed by the amateur singer and transmitted to the computer-based melody matching system 100, and can be associated with or include metadata describing the title of the media file, "Georgia on My Mind," and metadata describing the artist name, Ray Charles. The original composition, performed by Ray Charles, can be represented by media file information 114. Matching can be performed between the melodies associated with media file information 112 and media file information 114.

In some embodiments, the media file information 112, 114 can be or can include a melody fingerprint indicative of one or more fingerprints or signatures from the audio signal representative of the composition. As such, the melody fingerprint can be computed or derived based on the audio component of the composition. In some embodiments, the melody fingerprint can be stored in connection with unique identifiers identifying the composition, and can be accessed by the computer-based melody matching system 100 from a database (not shown) containing melody fingerprints for a number of different compositions.

Accordingly, as described above, the computer-based melody matching system 100 can perform its functions on the melody fingerprint, the metadata and/or other information associated with the media files.

Now turning back to the computer-based melody matching system 100, the melody match component 102 can be configured to receive the media file information 112, 114 and perform an algorithm to match media file information 112 from a user to the media file information 114 for the composition as performed by the professional artist. In one embodiment, when the media file information 112, 114 includes a melody fingerprint, the melody match component 102 can match a composition submitted by a user with the professionally recorded composition based on a similarity in fingerprints. Such matching can be performed independent of the metadata included with the media file information 112. As such, the metadata can be an additional and independent component by which matching can be performed.

The computer-based melody matching system 100 can also include the melody match strength estimation component (MMSEC) 104. The MMSEC 104 can estimate and associate a melody matching strength with the match identified by melody match component 102. The melody matching strength can be a value indicative of the strength of the match, and the strength can correlate to the confidence in the validity of the match. Accordingly, a greater melody matching strength value can be associated with a presumption of greater confidence that the match is a valid match.

Matches for which the associated melody matching strength is less than a particular threshold can be discarded to maintain a particular level of precision in matching. As used herein, the term "precision" can mean a rate of false positives. A "false positive" can mean an inaccurate identification of media file information 112, 114 (including melody fingerprints) as a valid match when the media file information 112, 114 does not match one another. By way of example, but not limitation, a false positive can occur if the melody match component 102 determines that media file information 112 and media file information 114 represent the same composition and, in fact, media file information 112 and media file information 114 represent different compositions by different artists, for example.

Figure 3:
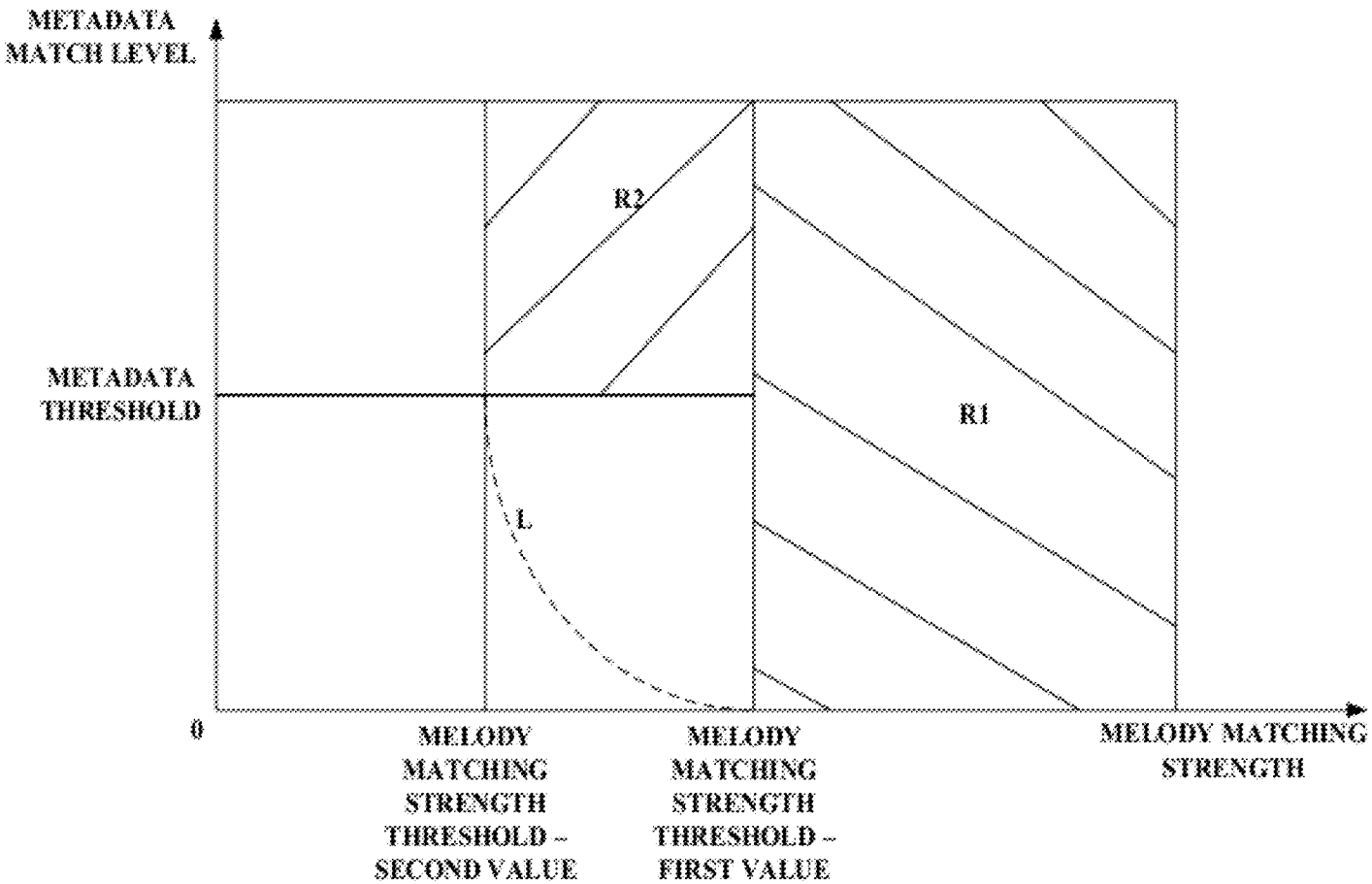
FIG. 3 is an illustration of a graph depicting parameters and regions of interest for facilitating higher confidence melody matching by a computer-based melody matching system.

Turning briefly to FIG. 3, a graph depicting parameters and regions of interest for facilitating high-confidence melody matching by the computer-based melody matching system 100 is shown. As depicted, the melody matching strength and the metadata match level for metadata are parameters of interest. The melody matching strength can be based on a match between melody information (and/or melody fingerprints) for compositions associated with the media file information 112, 114. If two renditions of the compositions are the same, the melody fingerprints can match, for example.

The metadata match level, and corresponding metadata threshold for the metadata match level, can be independent of the melody matching strength as the metadata threshold and the metadata match level are not affected by the melody matching strength for a particular set of matched media file information 112, 114.

In one embodiment, the melody matching strength can be set at one of two thresholds, depending on the level of confidence in a match between media file information 112, 114. The confidence in the match can be indicated by whether the metadata match level for metadata associated with the media file information 112 matches metadata associated with the media file information 114 at a level that is greater than the metadata threshold. Algorithms for matching text of the metadata can be utilized for determining the metadata match level.

Matches that are higher on the graph of FIG. 3 and further to the right denote matches having a higher confidence level. Rules for handling the corresponding media file information 112, 114 can be applied based on the level of confidence. For example, attribution to an artist, composer, and/or the content owner can be made if a level of confidence is sufficiently high.

Region R1 illustrates the region for matches based only on melody. R1 can be lower-bounded by the first value melody matching strength threshold. However, upon analysis of the metadata associated with the compositions being matched, if the metadata match level of the metadata is greater than the metadata threshold, the melody matching strength threshold can be reduced from the first value to the second value and, additional matches in region R2 can also be added to the total set of those with which a high-level of confidence is had. Accordingly, an increase in matches results while maintaining a certain level of precision. Precision decreases with false positives. In some embodiments, a false positive rate of approximately 1/1000 on average can be typical of high-confidence while a false positive rate greater than or equal to 5% is not indicative of high-confidence melody matching.

Without metadata-based matching, the melody matching strength threshold could be reduced from the first value to the second value but more false positives may result because there is a reduction in the strength based on the melody while no additional factors are considered (such as metadata matching) to increase the likelihood of valid matches.

Considering FIGS. 1 and 3, the melody matching strength can be set at a first value melody matching strength threshold when melody matching is performed via the melody match component 102. Accordingly, without the use of metadata, matches having a melody matching strength in the region R1 can be considered to meet a desired level of precision, and computer-based melody match system 100 can therefore proceed with identifying the compositions indicated by media file information 112, 114 as matches.

The confidence enhancement component 106 can increase the number of matches determined to be valid matches. As such, the regions of matches yielding a desired level of precision in computer-based melody matching system 100 can be increased from region R1 to combined regions R1 and R2.

Specifically, the confidence enhancement component 106 can receive and/or extract metadata associated with the media file information 112 received from a user, and metadata for the media file information 114 for the previously-recorded composition performed by the professional artist. The confidence enhancement component 106 can process the metadata and perform matching based on matches between metadata information. By way of example, but not limitation, the confidence enhancement component 106 can evaluate metadata indicative of a title of a media file embodying a composition performed and submitted by a user, and match the title with the media file information 114 if the media file information 114 includes the same title as the title in the metadata for media file information 112. A metadata threshold can be trained independent of the melody matching strength.

A metadata match level between the metadata of the media file information 112, 114 can be obtained by the confidence enhancement component 106. The metadata match level can be compared with a metadata threshold value.

If the metadata match level between the metadata for the media file information 112, 114 is greater than the metadata threshold, the melody matching strength threshold can be decreased from the first value to the second value. Accordingly, the melody match component 102 can identify matches that have a melody matching strength that is greater than the second value (as opposed to limiting the melody matching strength to be only greater than the first value).

Therefore, the number of valid matches identified can increase to those in regions R2 and R1 (instead of only region R1). Essentially, the melody matching strength threshold can be decreased due to confidence that valid matches will be made for the media file information 112, 114. The confidence in a valid match can be based on a sufficiently high metadata match level between the metadata of the media file information 112, 114.

In various embodiments, the melody matching strength threshold can be reduced from the first value to the second value according to a discontinuous function, such as that characterized by a step function. The computer-based melody matching system 100 generally, or the MMSEC 104 in particular, can reduce the melody matching strength threshold in various embodiments. In other embodiments, the change in value from the first value to the second value can be according to a continuous function (e.g., the function characterized by the line, L, in FIG. 3.

As such, the computer-based melody matching system 100 can simultaneously or concurrently utilize metadata and melody information (including, but not limited to, melody fingerprints, or signatures) to increase the number of valid matches while substantially maintaining precision in matching.

In various embodiments, the confidence enhancement component 106 can utilize video information associated with the media file information 112, 114. For example, the media file information 112, 114 can be or include a video channel. In some embodiments, a video channel can include a channel over which videos are distributed. In various embodiments, the videos can relate to user performances of a particular previously-recorded composition, for example. In another example, the videos can relate to renditions of one or more previously-recorded compositions performed by a particular artist (e.g., Ray Charles). Metadata about the video channel can be compared with one or more metadata for videos associated with the previously-recorded composition. The metadata match level between the metadata for the videos can be compared to the metadata threshold value.

If the metadata match level between the metadata associated with the videos is greater than the metadata threshold, the melody matching strength threshold can be decreased from a first value to a second value for the compositions associated with the videos. Accordingly, the melody match component 102 can identify matches that have a melody matching strength that is greater than the second value (as opposed to requiring that the melody matching strength be greater than the first value).

In other embodiments, the decision as to whether a match is valid can be a function of the metadata match level and the melody matching strength. For example, with reference to the FIG. 3, the metadata match level and melody matching strength can be determined, and the matches having metadata match level and melody matching strength values placing the matches in the regions R1 or R2 can be determined to be valid matches.

Microprocessor 108 can perform one or more of the functions described herein with reference to any of the systems and/or methods disclosed. The memory 110 can be a computer-readable storage medium storing computer-executable instructions and/or information for performing the functions described herein with reference to any of the systems and/or methods disclosed.

Figure 2:
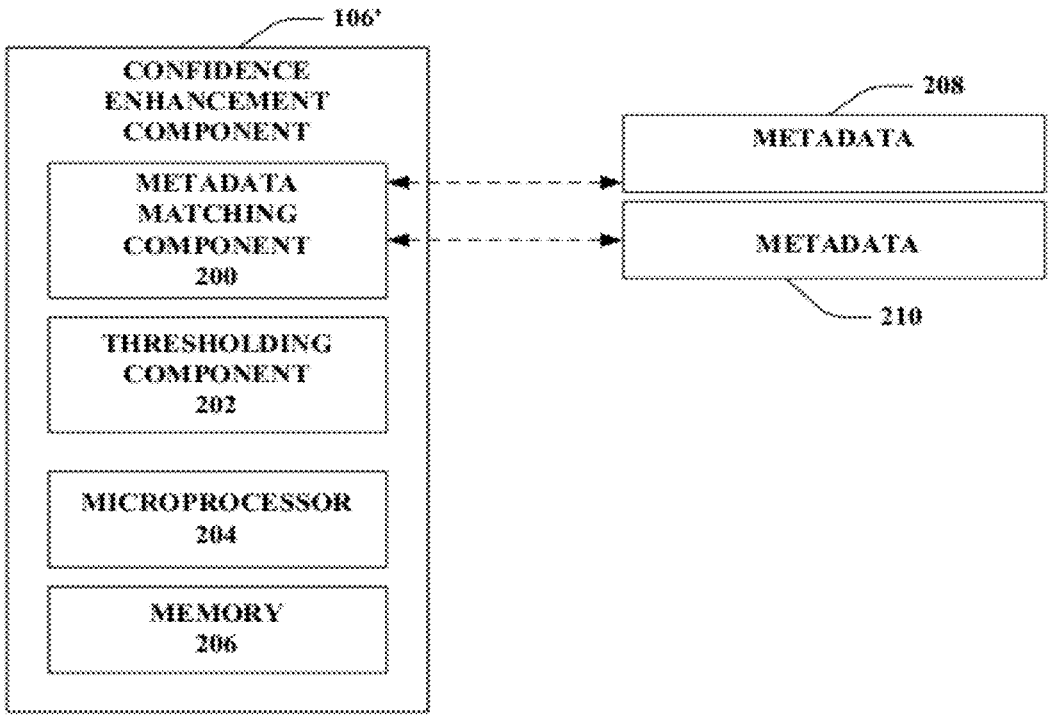
FIG. 2 is an illustration of a block diagram of an exemplary non-limiting confidence enhancement component configured to facilitate higher confidence melody matching by a computer-based melody matching system.

FIG. 2 is an illustration of a block diagram of an exemplary non-limiting confidence enhancement component configured to facilitate higher confidence melody matching by a computer-based melody matching system. In various embodiments, the confidence enhancement component can be employed in systems that perform fingerprinting of music and/or video works.

The confidence enhancement component 106' can include a metadata matching component 200, a thresholding component 202, a microprocessor 204 and a memory 206. One or more of the metadata matching component 200, thresholding component 202, microprocessor 204 and/or memory 206 can be electrically and/or communicatively coupled to one another to perform one or more of the functions described for the confidence enhancement component 106'. In some embodiments, the confidence enhancement component 106' can have the structure and/or perform one or more of the functions described above with reference to the confidence enhancement component 106 of FIG. 1 (and similarly, the confidence enhancement component 106 can have the structure and/or perform one or more of the functions of confidence enhancement component 106').

As shown in FIG. 2, the confidence enhancement component 106' can receive metadata 208, 210. The metadata 208, 210 can be associated with two respective media files (and/or fingerprints representative of compositions) from a user (e.g., a user performance) and for a previously-recorded composition (e.g., a Ray Charles performance).

The metadata matching component 200 can receive and/or extract the metadata 208, 210. The metadata matching component 200 can process the metadata 208, 210 and perform matching based on matches between the metadata 208, 210. By way of example, but not limitation, the metadata 208, 210 can be indicative of a title of a composition, a name of a professional artist that performs the composition, the title of a file associated with the composition or the like.

The thresholding component 202 can train metadata match levels of metadata to determine an appropriate metadata threshold. The thresholding component 202 can compare the metadata match level of the metadata 208, 210 to the metadata threshold.

If the metadata match level between the metadata 208, 210 is greater than the metadata threshold, the thresholding component 202 (or the confidence enhancement component 106', generally) can output a signal that can be received by the computer-based melody matching system 100 of FIG. 1. The signal can cause the computer-based melody matching system 100 to decrease a melody matching strength threshold from a first value to a second value based at least on the metadata match level being greater than the metadata threshold.

With reference to FIGS. 1, 2 and 3, accordingly, the melody match component 102 can regard as valid, matches that have a melody matching strength that is greater than a second value (as opposed to requiring that the melody matching strength be greater than a first value). Therefore, the number of valid matches identified can increase to those in regions R2 and R1 (instead of only region R1). Essentially, the threshold for melody matching, the melody matching strength threshold, can be decreased in certain circumstances due to increased confidence, by or using the confidence enhancement component 106, that valid matches will be made for the media file information 112, 114. The confidence can be based on a sufficiently high metadata match level between the corresponding respective metadata 208, 210 (e.g., title, name, fingerprints, signatures, and/or video channel).

In various embodiments, the melody matching strength threshold can be reduced from the first value to the second value according to a discontinuous function, such as that characterized by a step function. In other embodiments, the change in value from the first value to the second value can be according to a continuous function (e.g., the function characterized by the line, L, in FIG. 3.

As such, the computer-based melody matching system 100 can simultaneously or concurrently use metadata and melody information (including, but not limited to, melody fingerprints, or signatures) to increase the number of valid matches while substantially maintaining the precision previously obtained by limiting matches to those with a melody matching strength above a first (higher) threshold.

Microprocessor 204 can perform one or more of the functions described herein with reference to any of the systems and/or methods disclosed. In certain embodiments, microprocessor 204 is the same as microprocessor 108. The memory 206 can be a computer-readable storage medium storing computer-executable instructions and/or information for performing the functions described herein with reference to any of the systems and/or methods disclosed. In certain embodiments, memory 206 is the same as or part of memory 110.

Figure 4:
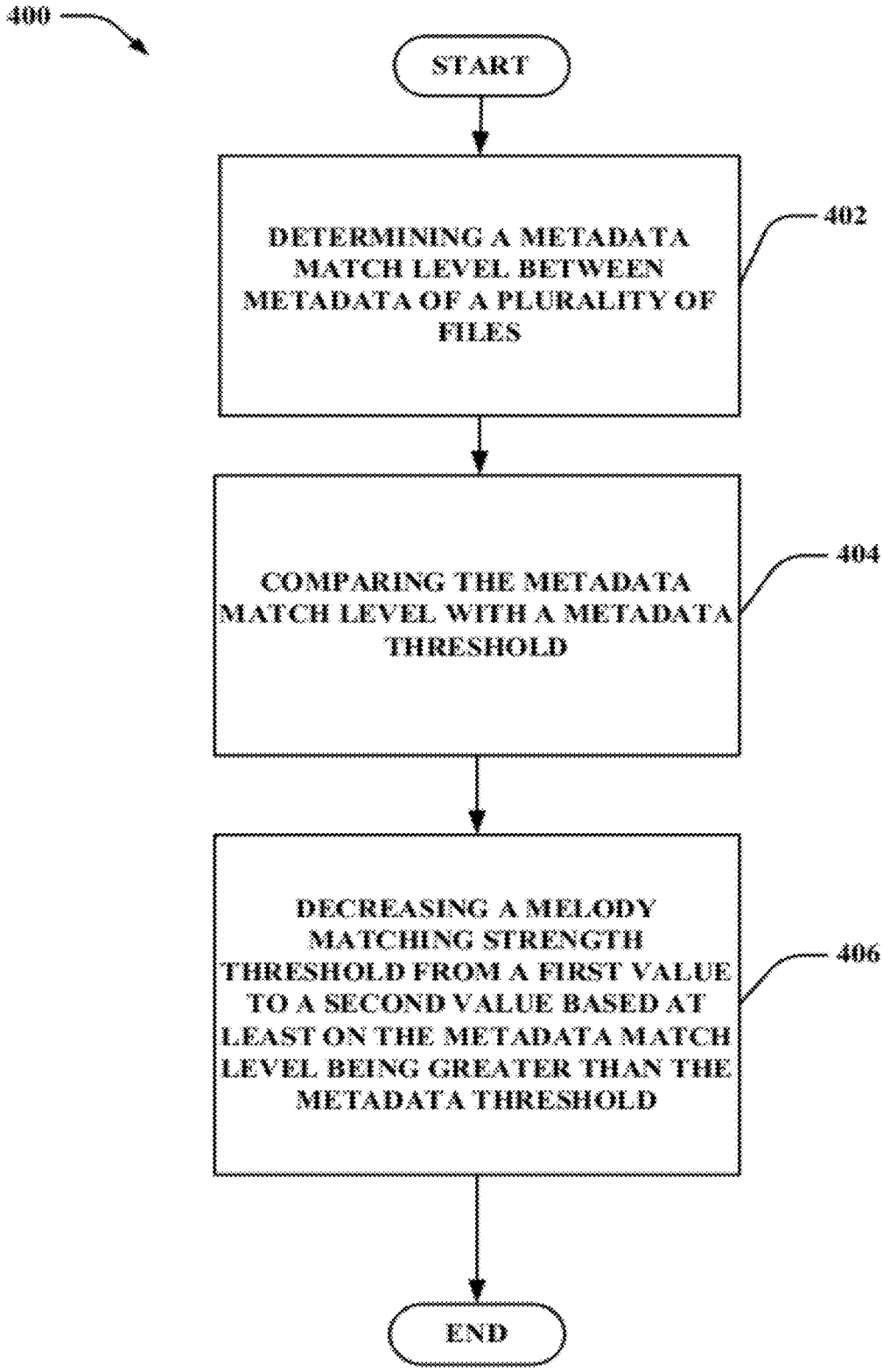
FIGS. 4-9 are illustrations of exemplary flow diagrams of methods that can facilitate higher confidence melody matching.

FIG. 4 is an illustration of an exemplary flow diagram of a method that can facilitate high-confidence melody matching. In some embodiments, the method 400 can be performed by a computer-based melody matching system (e.g., by computer-based melody matching system 100).

At 402, method 400 can include determining a metadata match level between metadata of a plurality of files (e.g., by the metadata matching component 200). In various embodiments, the files can include, but are not limited to, melody fingerprints, melody information, audio information, video information or the like. In various embodiments, the metadata can be indicative of a title of the associated file, a title of a composition associated with the file, a name of a professional artist that performs the composition or the like.

At 404, method 400 can include comparing the metadata match level with a metadata threshold (e.g., by the thresholding component 202). At 406, method 400 can include decreasing a melody matching strength threshold from a first value to a second value (e.g., by the MMSEC 104). The decrease can be based on one or more of the metadata match levels being greater than the metadata threshold. The melody matching strength can be indicative of a level of confidence in a match between the plurality of files based on melody information (or melody fingerprints) associated with the files.

Figure 5:
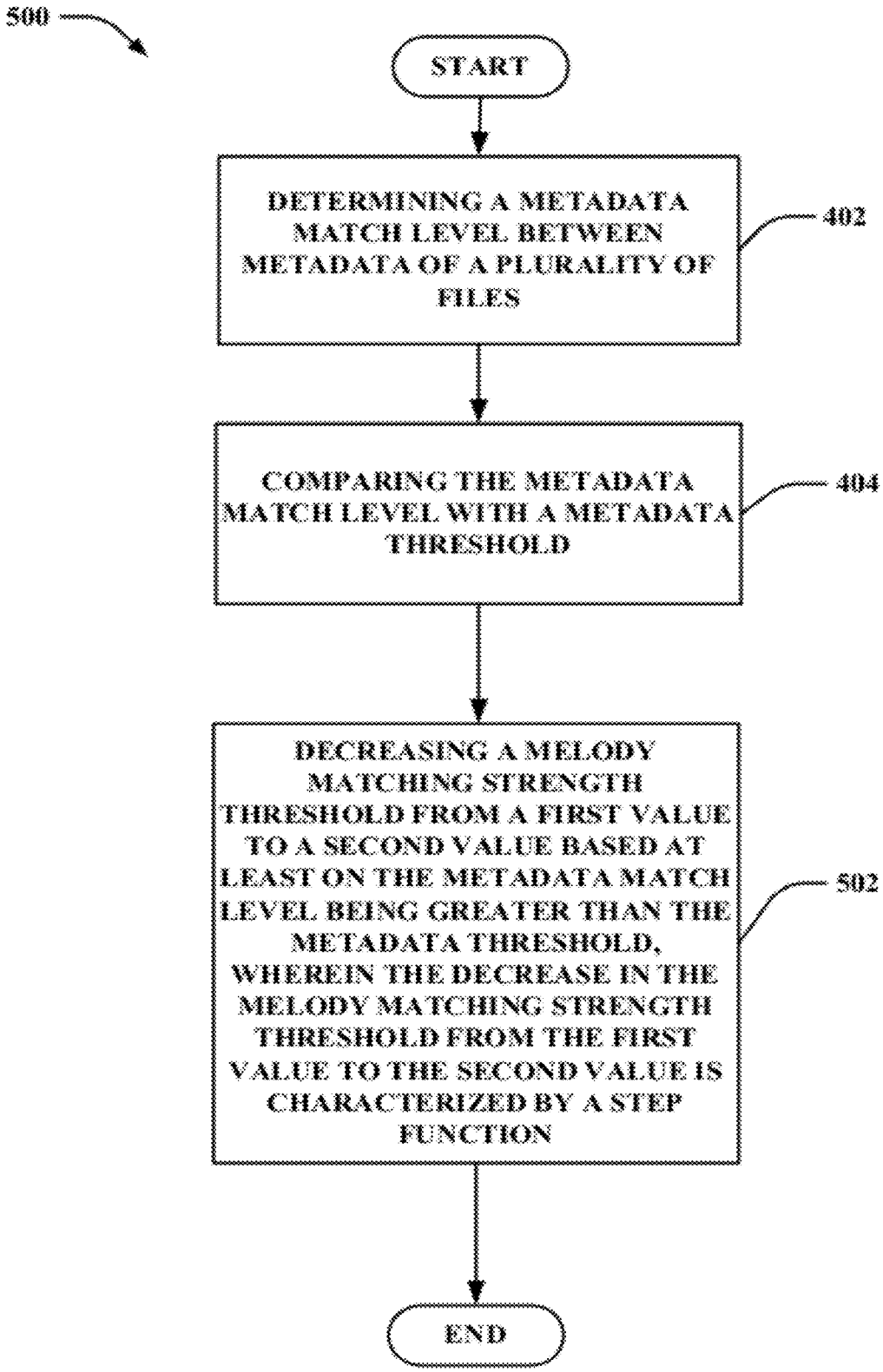

FIG. 5 is an illustration of an exemplary flow diagram of another method that can facilitate high-confidence melody matching. In some embodiments, the method 500 can be performed by a computer-based melody matching system (e.g., by computer-based melody matching system 100). In some embodiments, method 500 can include 402 and 404 of FIG. 4 (e.g., by the metadata matching component 200 and the thresholding component 202, respectively). At 502, method 500 can also include decreasing the melody matching strength from a first value to a second value, wherein the decrease in melody matching strength can be characterized by a step function (e.g., by the MMSEC 104).

Figure 6:
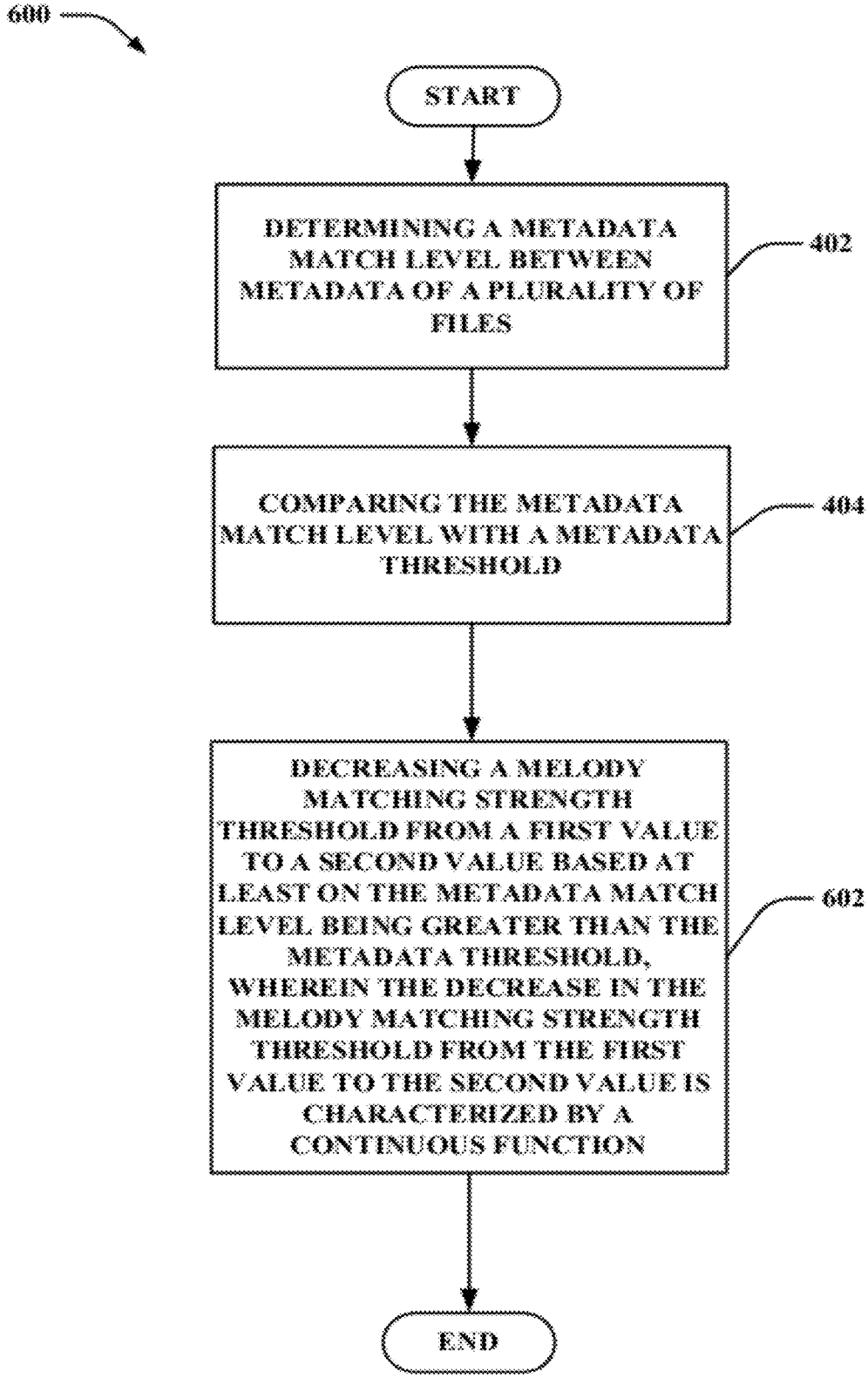

FIG. 6 is an illustration of an exemplary flow diagram of another method that can facilitate high-confidence melody matching. In some embodiments, the method 600 can be performed by a computer-based melody matching system (e.g., by computer-based melody matching system 100).

Method 600 can include 402 and 404 of FIG. 4 (e.g., by the metadata matching component 200 and the thresholding component 202, respectively). At 602, method 600 can also include decreasing the melody matching strength from a first value to a second value, wherein the decrease in melody matching strength can be characterized by a continuous function (e.g., by the MMSEC 104). In some embodiments, the continuous function can be represented by the line, L, shown in FIG. 3.

Figure 7:
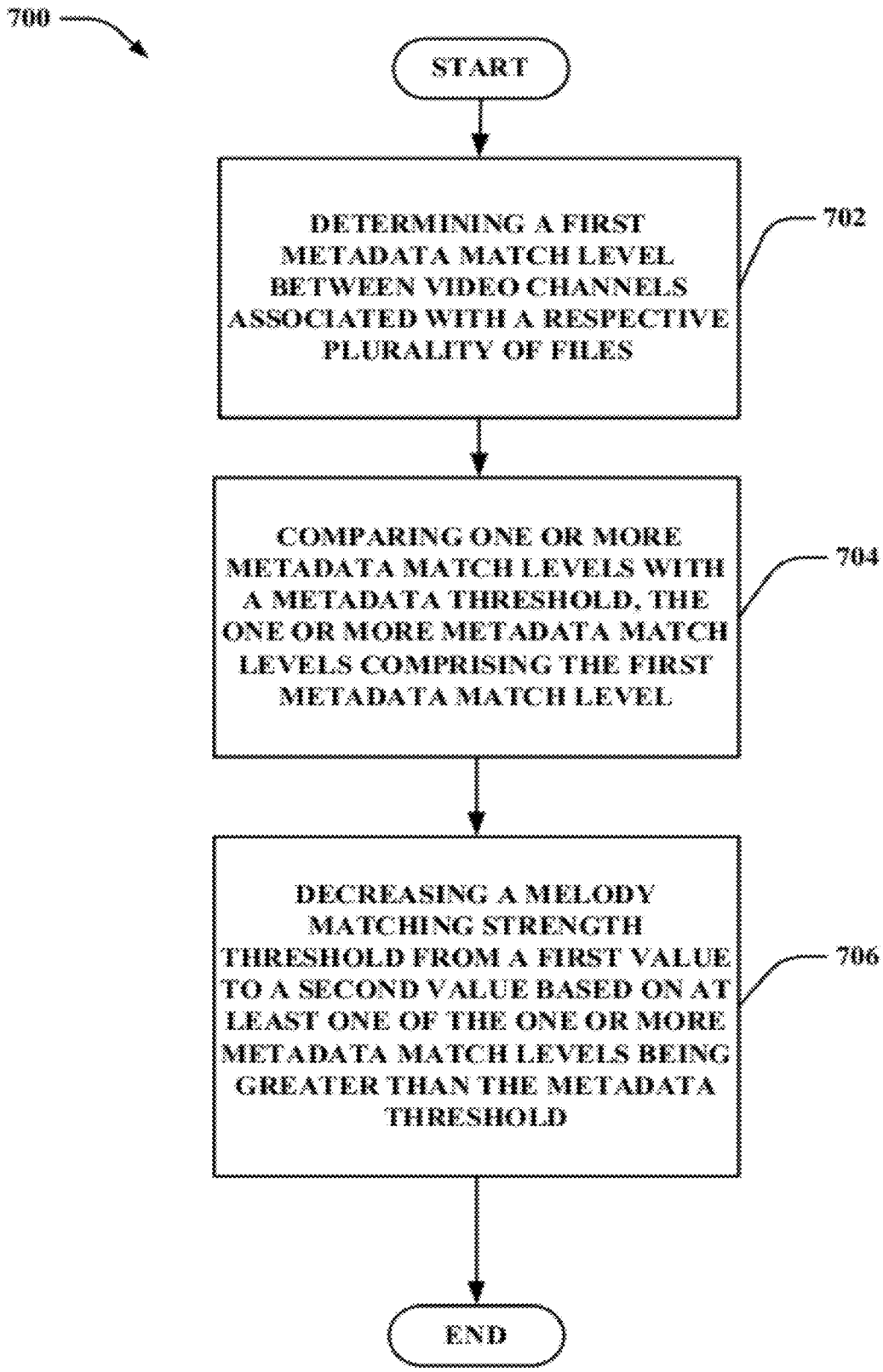

FIG. 7 is an illustration of an exemplary flow diagram of another method that can facilitate high-confidence melody matching. In some embodiments, the method 700 can be performed by a computer-based melody matching system (e.g., by computer-based melody matching system 100).

At 702, method 700 can include determining a first metadata match level between video channels associated with a respective plurality of files (e.g., by metadata matching component 200). At 704, method 700 can include comparing one or more metadata match levels with a metadata threshold (e.g., by the thresholding component 202). The one or more metadata match levels can include the first metadata match level in some embodiments.

At 706, method 700 can include decreasing a melody matching strength threshold from a first value to a second value (e.g., by the MMSEC 104). The decrease can be based on one or more of the metadata match levels being greater than the metadata threshold. In various embodiments, the decrease from the first value to the second value can be characterized by a step (or other discontinuous) function or by a continuous function.

Figure 8:
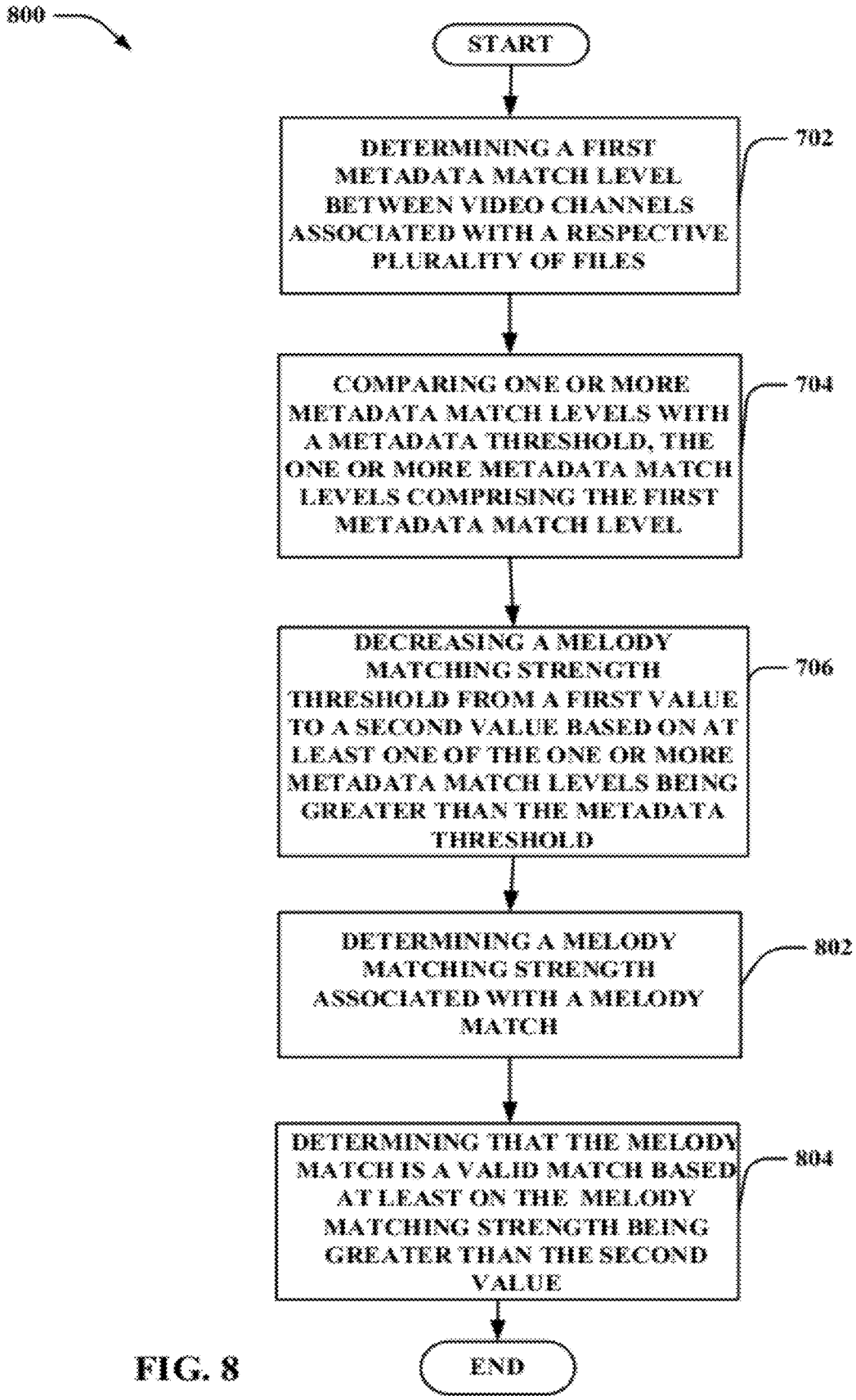

FIG. 8 is an illustration of an exemplary flow diagram of another method that can facilitate high-confidence melody matching. In some embodiments, the method 800 can be performed by a computer-based melody matching system (e.g., by computer-based melody matching system 100).

At 702, method 800 can include determining a first metadata match level between video channels associated with a respective plurality of files (e.g., by the metadata matching component 200). At 704, method 800 can include comparing one or more metadata match levels with a metadata threshold (e.g., by the thresholding component 202). The one or more metadata match levels can include the first metadata match level in some embodiments.

At 706, method 800 can include decreasing a melody matching strength threshold from a first value to a second value (e.g., by the MMSEC 104). The decrease can be based on one or more of the metadata match levels being greater than the metadata threshold.

Further, at 802, method 800 can include determining a melody matching strength associated with a melody match for the plurality of files (e.g., by the MMSEC 104). At 804, method 800 can include determining that the melody match is a valid match based, at least, on the melody matching strength being greater than the second value to which the melody matching strength threshold has been reduced (e.g., by the melody match component 102). In various embodiments, the decrease from the first value to the second value can be characterized by a step function or by a continuous function.

Figure 9:
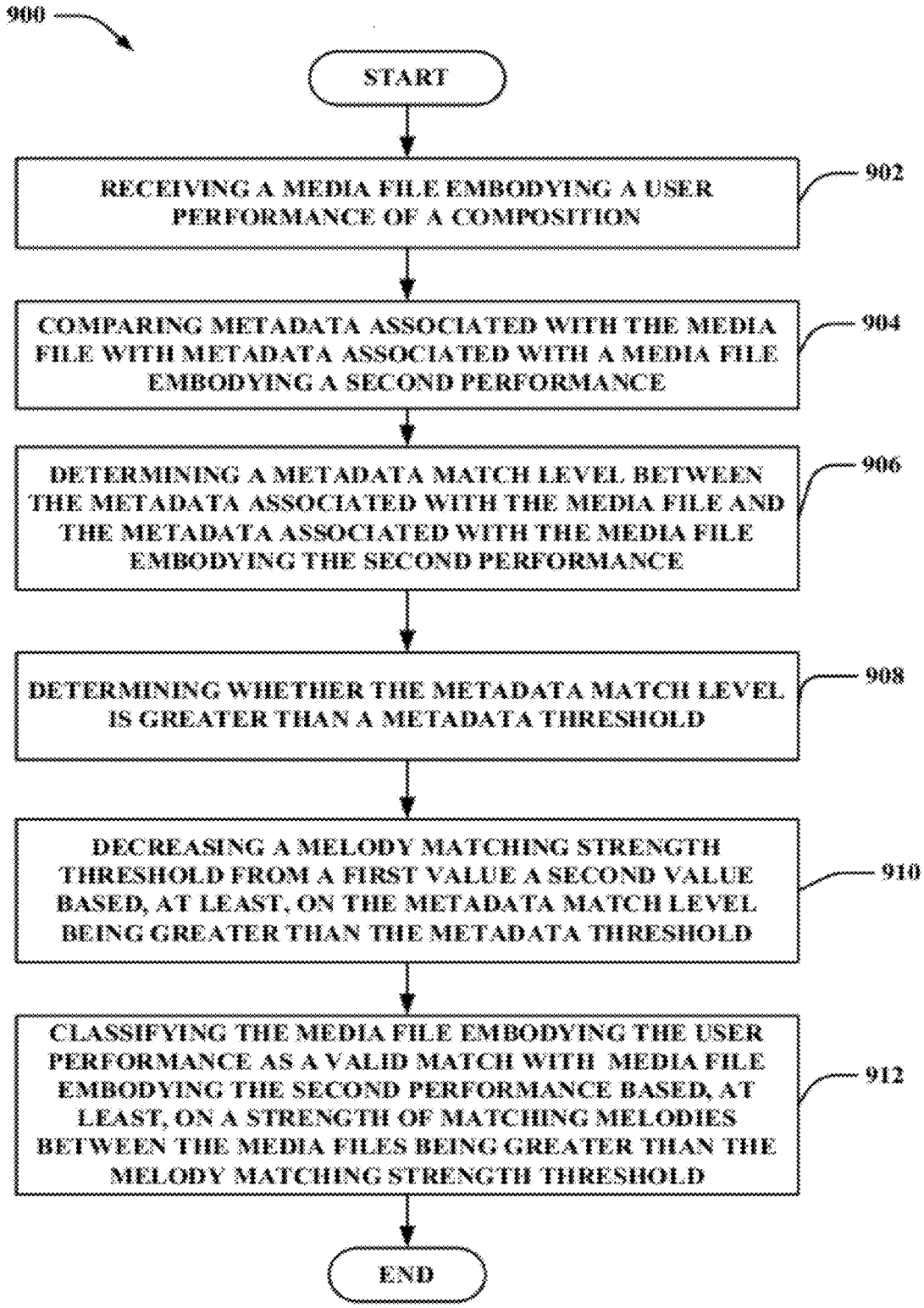

FIG. 9 is an illustration of an exemplary flow diagram of another method that can facilitate high-confidence melody matching. In some embodiments, the method 900 can be performed by a computer-based melody matching system (e.g., by computer-based melody matching system 100).

At 902, method 900 can include receiving a media file embodying a user performance of a composition (e.g., by a computer-based melody matching system 100). At 904, method 900 can include comparing metadata associated with the media file with metadata associated with a media file embodying a second performance (e.g., by a metadata matching component 200).

At 906, method 900 can include determining a metadata match level between the metadata associated with the media file and the metadata associated with the media file embodying the second performance (e.g., by the metadata matching component 200).

At 908, method 900 can include determining whether the metadata match level is greater than a metadata threshold (e.g., by the thresholding component 202). At 910, method 900 can include decreasing a melody matching strength threshold from a first value a second value based, at least, on the metadata match level being greater than the metadata threshold (e.g., by the MMSEC 104). The decrease from the first value to the second value can be characterized by a continuous function in some embodiments, and by a step function in other embodiments.

At 912, method 900 can include classifying the media file embodying the user performance as a valid match with the media file embodying the second performance based, at least, on a strength of matching melodies between the media files being greater than the melody matching strength threshold (e.g., by the melody match component 102). Although not shown, method 900 can also include maintaining the melody matching strength threshold at the first value based, at least, on the metadata match level being less than the metadata threshold (e.g., by the MMSEC 104).

Figure 10:
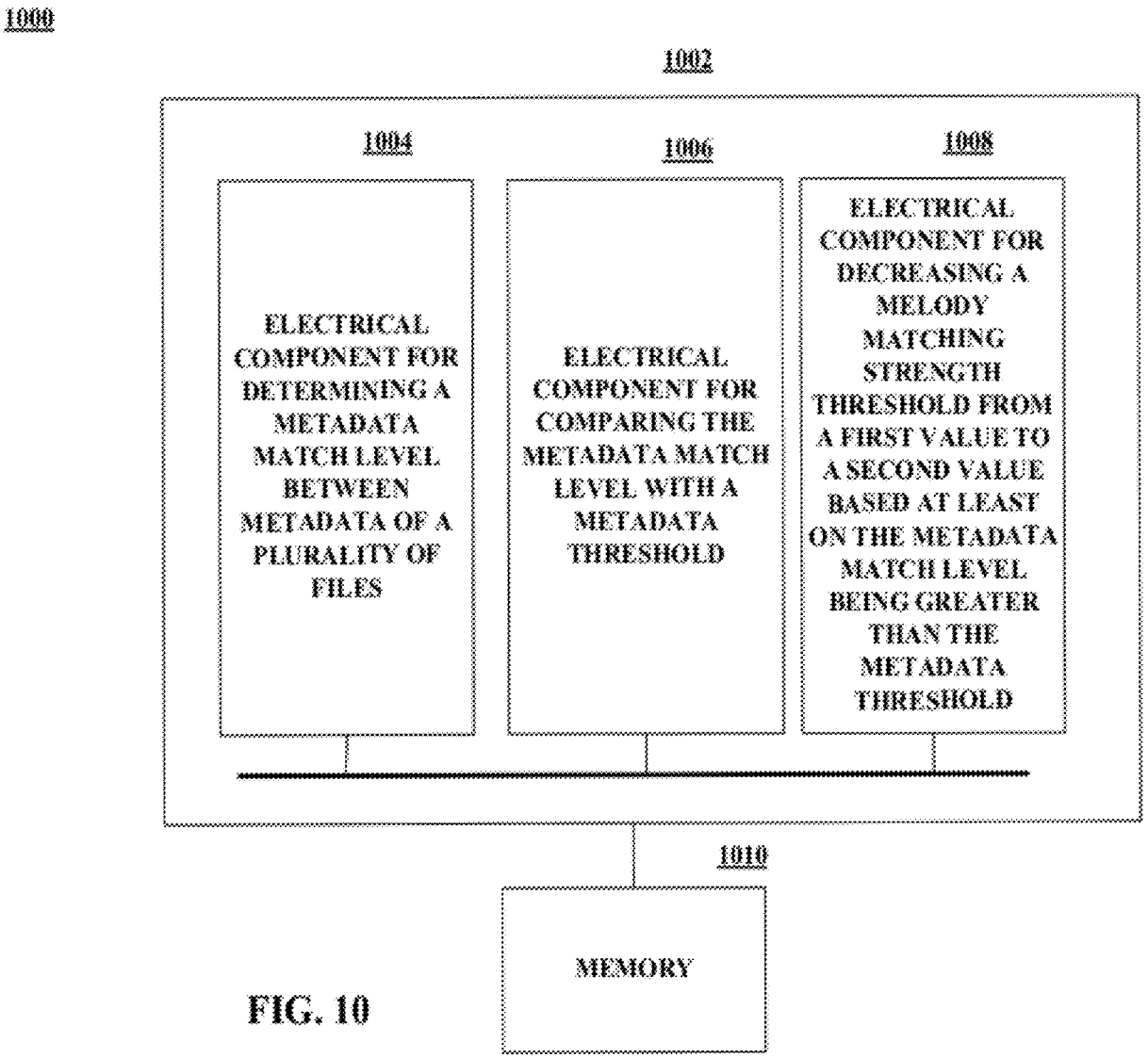
FIGS. 10-12 are illustrations of block diagrams of exemplary non-limiting systems that can facilitate higher confidence melody matching.
Figure 11:
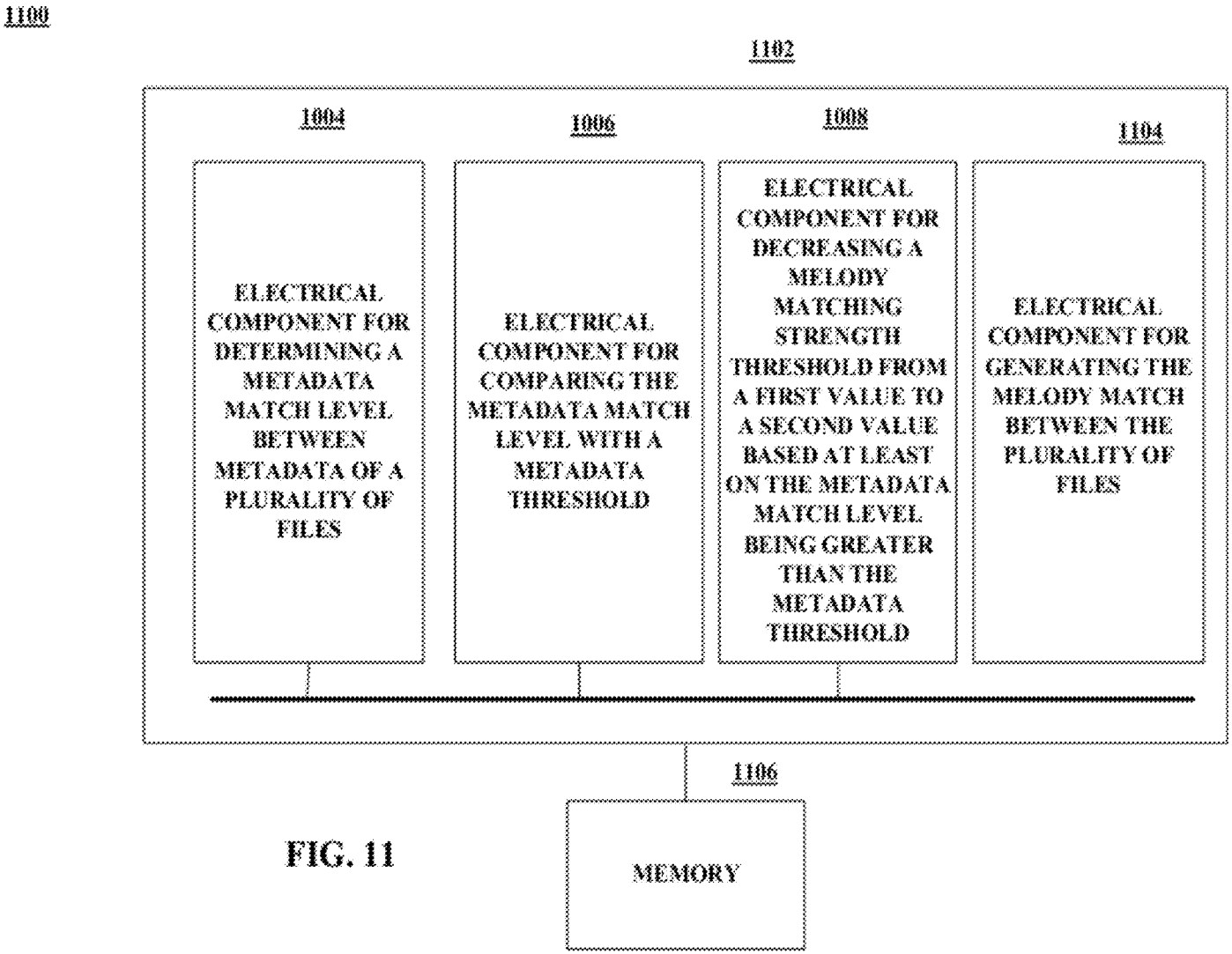
Figure 12:
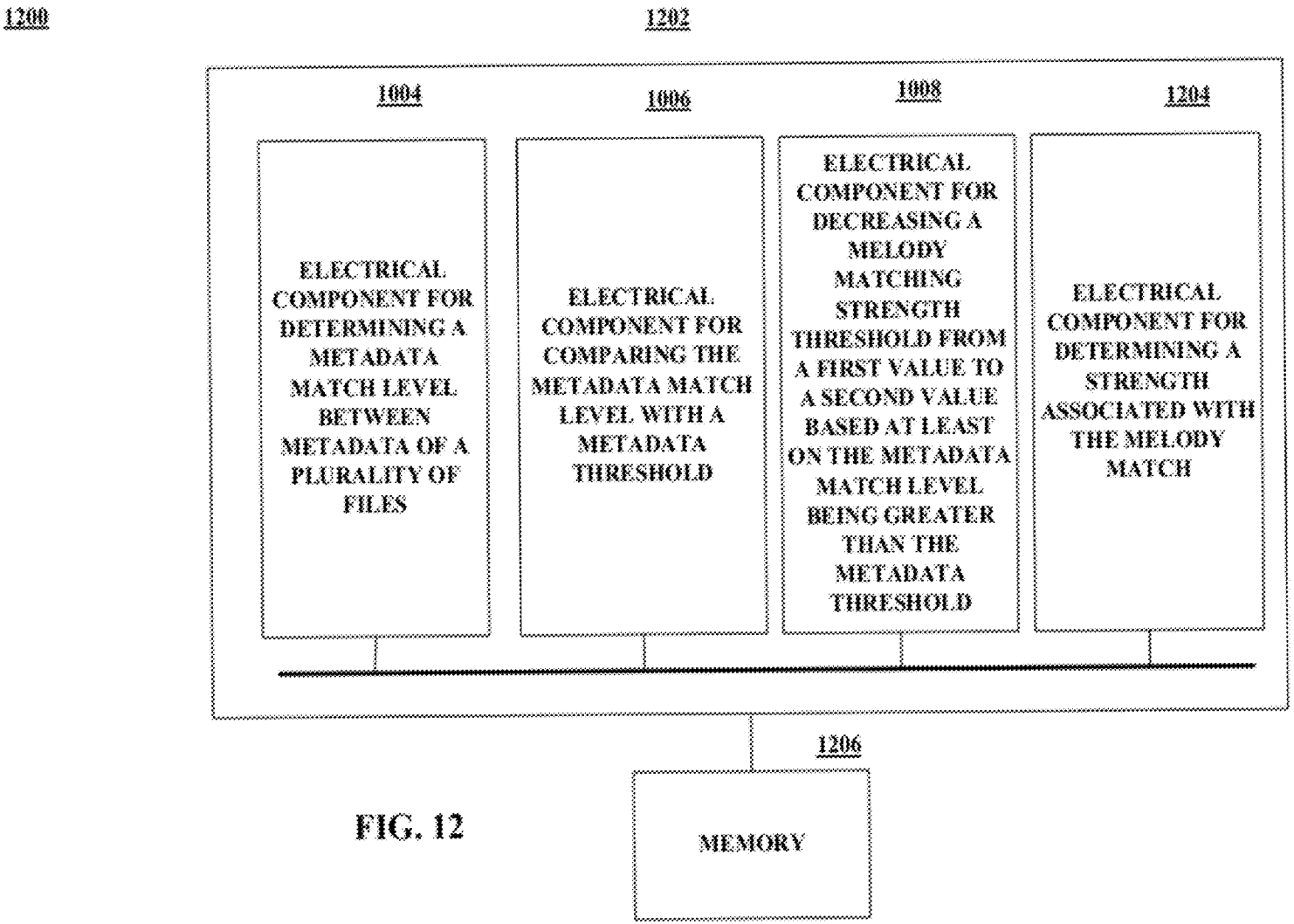

FIGS. 10-12 are illustrations of block diagrams of exemplary non-limiting systems that can facilitate confidence in computer-based melody matching. Turning first to FIG. 10, system 1000 is depicted. System 1000 can include a logical or physical grouping 1002 of electrical components. The electrical components can act in conjunction with one another. For example, logical or physical grouping 1002 can include an electrical component 1004 for determining a metadata match level between metadata of a plurality of files. In various embodiments, the media files can include audio and/or video signals. The metadata can describe a title and/or author of an audio composition embodied in the media file. In some embodiments, the metadata can describe content of video embodied in the media file.

Logical or physical grouping 1002 can include an electrical component 1006 for comparing the metadata match level between the metadata of the media files with a metadata threshold. Logical or physical grouping 1002 can also include an electrical component 1008 for decreasing a melody matching strength threshold from a first value to a second value. The decrease from the first value to the second value can be based on a number of factors including, but not limited to, the metadata match level between the metadata of the media files being greater than the metadata threshold. In various embodiments, the decrease from the first value to the second value can be characterized by a step (or other discontinuous) function and/or a continuous function. Accordingly, the first value and the second value can be values along a curve of a step (or other discontinuous) function or a continuous function.

The logical or physical grouping 1002 can also include an electrical component 1010 for storing. The electrical component 1010 for storing can store information including, but not limited to, the metadata threshold, one or more metadata match levels, metadata thresholds, melody matching strength thresholds, metadata, media files, first and second values for the melody matching strength threshold and the like.

Turning now to FIG. 11, system 1100 is depicted. System 1100 can include logical or physical groupings 1004, 1006 and 1008 described above with reference to FIG. 10. Additionally, the logical or physical grouping 1102 of system 1100 can include an electrical component 1104 for generating the melody match between the plurality of files. Further, the logical or physical grouping 1102 can also include an electrical component 1106 for storing. The electrical component 1106 for storing can store information including, but not limited to, the metadata threshold, one or more metadata match levels, metadata thresholds, melody matching strength thresholds, metadata, media files, first and second values for the melody matching strength threshold, information and/or algorithms for generating the melody match between files, and the like.

Turning now to FIG. 12, system 1200 is depicted. System 1200 can include logical or physical groupings 1004, 1006 and 1008 described above with reference to FIG. 10. Additionally, the logical or physical grouping 1202 of system 1200 can include an electrical component 1204 for determining a strength associated with the melody match. Further, the logical or physical grouping 1202 can also include an electrical component 1206 for storing. The electrical component 1206 for storing can store information including, but not limited to, the metadata threshold, one or more metadata match levels, metadata thresholds, melody matching strength thresholds, metadata, media files, first and second values for the melody matching strength threshold, information and/or algorithms for determining the strength associated with the melody match between files, and the like.

Exemplary Networked and Distributed Environments

One of ordinary skill in the art can appreciate that the various embodiments described herein can be implemented in connection with any computer or other client or server device, which can be deployed as part of a computer network or in a distributed computing environment, and can be connected to any kind of data store where media may be found. In this regard, the various embodiments described herein can be implemented in any computer system or environment having any number of memory or storage units, and any number of applications and processes occurring across any number of storage units. This includes, but is not limited to, an environment with server computers and client computers deployed in a network environment or a distributed computing environment, having remote or local storage.

Distributed computing provides sharing of computer resources and services by communicative exchange among computing devices and systems. These resources and services include the exchange of information, cache storage and disk storage for objects, such as files. These resources and services can also include the sharing of processing power across multiple processing units for load balancing, expansion of resources, specialization of processing, and the like. Distributed computing takes advantage of network connectivity, allowing clients to leverage their collective power to benefit the entire enterprise. In this regard, a variety of devices may have applications, objects or resources that may participate in the various embodiments of this disclosure.

Figure 13:
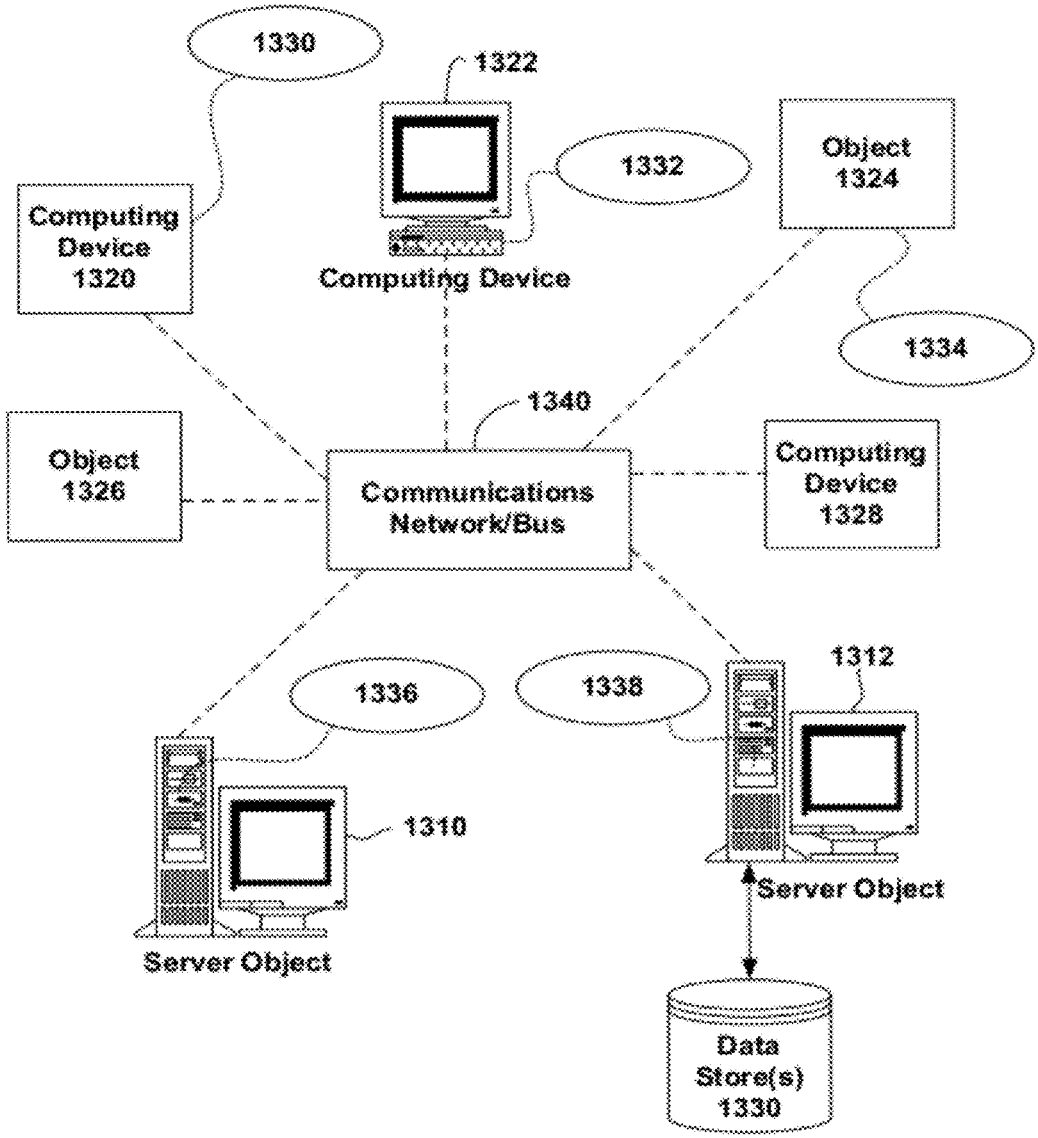
FIG. 13 is an illustration of a schematic diagram of an exemplary networked or distributed computing environment for implementing one or more embodiments described herein.

FIG. 13 provides a schematic diagram of an exemplary networked or distributed computing environment in which embodiments described herein can be implemented. The distributed computing environment includes computing objects 1310, 1312, etc. and computing objects or devices 1320, 1322, 1324, 1326, 1328, etc., which can include programs, methods, data stores, programmable logic, etc., as represented by applications 1330, 1332, 1334, 1336, 1338. It can be appreciated that computing objects 1310, 1312, etc. and computing objects or devices 1320, 1322, 1324, 1326, 1328, etc. can include different devices, such as personal digital assistants (PDAs), audio/video devices, mobile phones, MPEG-1 Audio Layer 3 (MP3) players, personal computers, laptops, tablets, etc.

Each computing object 1310, 1312, etc. and computing objects or devices 1320, 1322, 1324, 1326, 1328, etc. can communicate with one or more other computing objects 1310, 1312, etc. and computing objects or devices 1320, 1322, 1324, 1326, 1328, etc. by way of the communications network 1340, either directly or indirectly. Even though illustrated as a single element in FIG. 13, network 1340 can include other computing objects and computing devices that provide services to the system of FIG. 13, and/or can represent multiple interconnected networks, which are not shown. Each computing object 1310, 1312, etc. or computing objects or devices 1320, 1322, 1324, 1326, 1328, etc. can also contain an application, such as applications 1330, 1332, 1334, 1336, 1338, that might make use of an application programming interface (API), or other object, software, firmware and/or hardware, suitable for communication with or implementation of the various embodiments of the subject disclosure.

There are a variety of systems, components, and network configurations that support distributed computing environments. For example, computing systems can be connected together by wired or wireless systems, by local networks or widely distributed networks. Currently, many networks are coupled to the Internet, which provides an infrastructure for widely distributed computing and encompasses many different networks, though any network infrastructure can be used for exemplary communications made incident to the systems as described in various embodiments.

Thus, a host of network topologies and network infrastructures, such as client/server, peer-to-peer, or hybrid architectures, can be utilized. The client can be a member of a class or group that uses the services of another class or group. A client can be a computer process, e.g., roughly a set of instructions or tasks, that requests a service provided by another program or process. A client can utilize the requested service without having to know all working details about the other program or the service itself.

As used in this application, the terms "component," "module," "system," and the like are intended to refer to a computer-related entity, either hardware, software, firmware, a combination of hardware and software, software and/or software in execution. For example, a component can be, but is not limited to being, a process running on a processor, a processor, an object, an executable, a thread of execution, a program, and/or a computer. By way of illustration, both an application running on a computing device and/or the computing device can be a component. One or more components can reside within a process and/or thread of execution and a component can be localized on one computer and/or distributed between two or more computers. In addition, these components can execute from various computer-readable storage media having various data structures stored thereon. The components can communicate by way of local and/or remote processes such as in accordance with a signal having one or more data packets (e.g., data from one component interacting with another component in a local system, distributed system, and/or across a network such as the Internet with other systems by way of the signal).

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

In a client/server architecture, particularly a networked system, a client can be a computer that accesses shared network resources provided by another computer, e.g., a server. In the illustration of FIG. 13, as a non-limiting example, computing objects or devices 1320, 1322, 1324, 1326, 1328, etc. can be thought of as clients and computing objects 1310, 1312, etc. can be thought of as servers where computing objects 1310, 1312, etc. provide data services, such as receiving data from client computing objects or devices 1320, 1322, 1324, 1326, 1328, etc., storing of data, processing of data, transmitting data to client computing objects or devices 1320, 1322, 1324, 1326, 1328, etc., although any computer can be considered a client, a server, or both, depending on the circumstances. Any of these computing devices can process data, or request transaction services or tasks that can implicate the techniques for systems as described herein for one or more embodiments.

A server can be typically a remote computer system accessible over a remote or local network, such as the Internet or wireless network infrastructures. The client process can be active in a first computer system, and the server process can be active in a second computer system, communicating with one another over a communications medium, thus providing distributed functionality and allowing multiple clients to take advantage of the information-gathering capabilities of the server. Any software objects utilized pursuant to the techniques described herein can be provided standalone, or distributed across multiple computing devices or objects.

In a network environment in which the communications network/bus 1340 can be the Internet, for example, the computing objects 1310, 1312, etc. can be Web servers, file servers, media servers, etc. with which the client computing objects or devices 1320, 1322, 1324, 1326, 1328, etc. communicate via any of a number of known protocols, such as the hypertext transfer protocol (HTTP). Objects 1310, 1312, etc. can also serve as client computing objects or devices 1320, 1322, 1324, 1326, 1328, etc., as can be characteristic of a distributed computing environment.

Exemplary Computing Device

Figure 14:
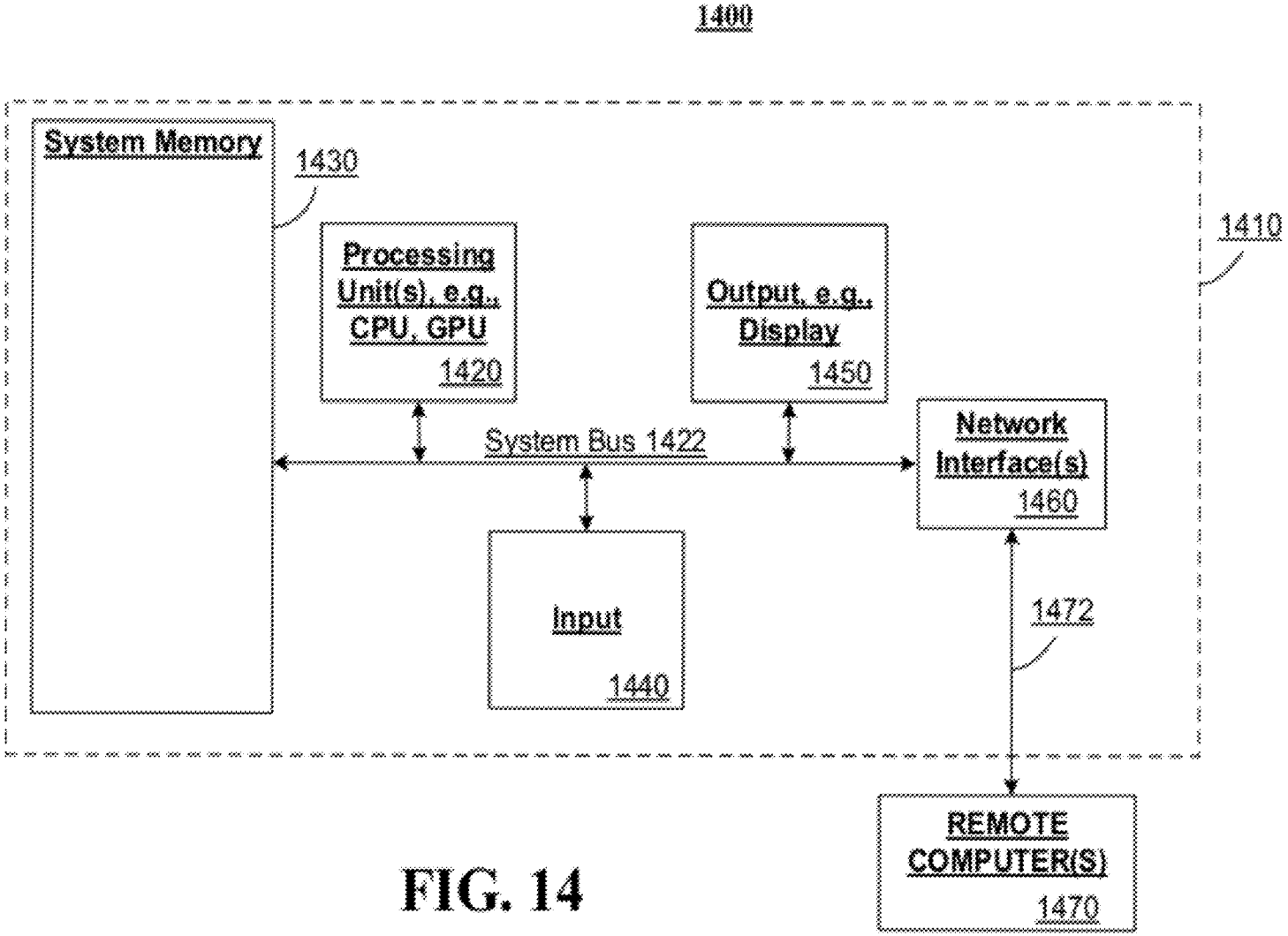
FIG. 14 is an illustration of a schematic diagram of an exemplary computing environment for implementing one or more embodiments described herein.

As mentioned, advantageously, the techniques described herein can be applied to any suitable device. It is to be understood, therefore, that handheld, portable and other computing devices and computing objects of all kinds are contemplated for use in connection with the various embodiments, i.e., anywhere that a device may wish to read or write transactions from or to a data store. Accordingly, the below remote computer described below in FIG. 14 is but one example of a computing device. Additionally, a suitable server can include one or more aspects of the below computer, such as a media server or other media management server components.

Although not required, embodiments can be partly implemented via an operating system, for use by a developer of services for a device or object, and/or included within application software that operates to perform one or more functional aspects of the various embodiments described herein. Software can be described in the general context of computer executable instructions, such as program modules, being executed by one or more computers, such as client workstations, servers or other devices. Those skilled in the art will appreciate that computer systems have a variety of configurations and protocols that can be used to communicate data, and thus, no particular configuration or protocol is to be considered limiting.

FIG. 14 thus illustrates an example of a suitable computing system environment 1400 in which one or aspects of the embodiments described herein can be implemented, although as made clear above, the computing system environment 1400 is only one example of a suitable computing environment and is not intended to suggest any limitation as to scope of use or functionality. Neither is the computing environment 1400 to be interpreted as having any dependency or requirement relating to any one or combination of components illustrated in the exemplary operating environment 1400.

With reference to FIG. 14, an exemplary computing environment 1400 for implementing one or more embodiments includes a computing device in the form of a computer 1410 is provided. Components of computer 1410 can include, but are not limited to, a processing unit 1420, a system memory 1430, and a system bus 1422 that couples various system components including the system memory to the processing unit 1420.

Computer 1410 typically includes a variety of computer readable media and can be any available media that can be accessed by computer 1410. The system memory 1430 can include computer storage media in the form of volatile and/or nonvolatile memory such as read only memory (ROM) and/or random access memory (RAM). In various embodiments, system memory 1430 can be, for example, memory 110, 206, 1010, 1106, and/or 1206. By way of example, and not limitation, memory 1430 can also include an operating system, application programs, other program modules, and program data.

A user can enter commands and information into the computer 1410 through input devices 1440, non-limiting examples of which can include a keyboard, keypad, a pointing device, a mouse, stylus, touchpad, touchscreen, trackball, motion detector, camera, microphone, joystick, game pad, scanner, video camera or any other device that allows the user to interact with the computer 1410. A monitor or other type of display device can be also connected to the system bus 1422 via an interface, such as output interface 1450. In addition to a monitor, computers can also include other peripheral output devices such as speakers and a printer, which can be connected through output interface 1450.

The computer 1410 can operate in a networked or distributed environment using logical connections to one or more other remote computers, such as remote computer 1470. The remote computer 1470 can be a personal computer, a server, a router, a network PC, a peer device or other common network node, or any other remote media consumption or transmission device, and can include any or all of the elements described above relative to the computer 1410. The logical connections depicted in FIG. 14 include a network 1472, such local area network (LAN) or a wide area network (WAN), but can also include other networks/buses e.g., cellular networks.

As mentioned above, while exemplary embodiments have been described in connection with various computing devices and network architectures, the underlying concepts can be applied to any network system and any computing device or system in which it is desirable to publish or consume media in a flexible way.

Also, there are multiple ways to implement the same or similar functionality, e.g., an appropriate API, tool kit, driver code, operating system, control, standalone or downloadable software object, etc. which enables applications and services to take advantage of the techniques detailed herein. Thus, embodiments herein are contemplated from the standpoint of an API (or other software object), as well as from a software or hardware object that implements one or more aspects described herein. Thus, various embodiments described herein can have aspects that are wholly in hardware, partly in hardware and partly in software, as well as in software.

Computing devices typically include a variety of media, which can include computer-readable storage media and/or communications media, in which these two terms are used herein differently from one another as follows. Computer-readable storage media can be any available storage media that can be accessed by the computer, can be typically of a non-transitory nature, and can include both volatile and non-volatile media, removable and non-removable media. By way of example, and not limitation, computer-readable storage media can be implemented in connection with any method or technology for storage of information such as computer-readable instructions, program modules, structured data, or unstructured data. Computer-readable storage media can include, but are not limited to, RAM, ROM, electrically erasable programmable read only memory (EEPROM), flash memory or other memory technology, compact disc read only memory (CD-ROM), digital versatile disk (DVD) or other optical disk storage, magnetic cassettes, magnetic tape, magnetic disk storage or other magnetic storage devices, or other tangible and/or non-transitory media which can be used to store desired information. Computer-readable storage media can be accessed by one or more local or remote computing devices, e.g., via access requests, queries or other data retrieval protocols, for a variety of operations with respect to the information stored by the medium.

On the other hand, communications media typically embody computer-readable instructions, data structures, program modules or other structured or unstructured data in a data signal such as a modulated data signal, e.g., a carrier wave or other transport mechanism, and includes any information delivery or transport media. The term "modulated data signal" or signals refers to a signal that has one or more of its characteristics set or changed in such a manner as to encode information in one or more signals. By way of example, and not limitation, communication media include wired media, such as a wired network or direct-wired connection, and wireless media such as acoustic, radio frequency (RF), infrared and other wireless media.

It is to be understood that the embodiments described herein can be implemented in hardware, software, firmware, middleware, microcode, or any combination thereof. For a hardware implementation, the processing units can be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors and/or other electronic units designed to perform the functions described herein, or a combination thereof.

When the embodiments are implemented in software, firmware, middleware or microcode, program code or code segments, they can be stored in a machine-readable medium (or a computer-readable storage medium), such as a storage component. A code segment can represent a procedure, a function, a subprogram, a program, a routine, a subroutine, a module, a software package, a class, or any combination of instructions, data structures, or program statements. A code segment can be coupled to another code segment or a hardware circuit by passing and/or receiving information, data, arguments, parameters, or memory contents. Information, arguments, parameters, data, etc. can be passed, forwarded, or transmitted using any suitable means including memory sharing, message passing, token passing, network transmission, etc.

For a software implementation, the techniques described herein can be implemented with modules or components (e.g., procedures, functions, and so on) that perform the functions described herein. The software codes can be stored in memory units and executed by processors. A memory unit can be implemented within the processor or external to the processor, in which case it can be communicatively coupled to the processor via various structures.

The word "exemplary" is used herein to mean serving as an example, instance, or illustration. For the avoidance of doubt, the subject matter disclosed herein is not limited by such examples. In addition, any aspect or design described herein as "exemplary" is not necessarily to be construed as preferred or advantageous over other aspects or designs, nor is it meant to preclude equivalent exemplary structures and techniques known to those of ordinary skill in the art. Furthermore, to the extent that the terms "includes," "has," "contains," and other similar words are used in either the detailed description or the claims, for the avoidance of doubt, such terms are intended to be inclusive in a manner similar to the term "comprising" as an open transition word without precluding any additional or other elements.

What has been described above includes examples of one or more embodiments. It is, of course, not possible to describe every conceivable combination of components or methodologies for purposes of describing the aforementioned embodiments, but one of ordinary skill in the art can recognize that many further combinations and permutations of various embodiments are possible. Accordingly, the described embodiments are intended to embrace all such alterations, modifications and variations that fall within the spirit and scope of the appended claims. Moreover, use of the term "an embodiment" or "one embodiment" throughout is not intended to mean the same embodiment unless specifically described as such. Further, use of the term "plurality" can mean two or more.

The aforementioned systems have been described with respect to interaction between several components. It can be appreciated that such systems and components can include those components or specified sub-components, some of the specified components or sub-components, and/or additional components, and according to various permutations and combinations of the foregoing. Sub-components can also be implemented as components communicatively coupled to other components rather than included within parent components (hierarchical). Additionally, it is to be noted that one or more components can be combined into a single component providing aggregate functionality or divided into several separate sub-components, and that any one or more middle layers, such as a management layer, can be provided to communicatively couple to such sub-components in order to provide integrated functionality. Any components described herein can also interact with one or more other components not specifically described herein but generally known by those of skill in the art.

In view of the exemplary systems described above methodologies that can be implemented in accordance with the described subject matter will be better appreciated with reference to the flowcharts of the various figures. While for purposes of simplicity of explanation, the methodologies are shown and described as a series of blocks, it is to be understood and appreciated that the claimed subject matter is not limited by the order of the blocks, as some blocks can occur in different orders and/or concurrently with other blocks from what is depicted and described herein. Where non-sequential, or branched, flow is illustrated via flowchart, it can be appreciated that various other branches, flow paths, and orders of the blocks, can be implemented which achieve the same or a similar result. Moreover, not all illustrated blocks can be required to implement the methodologies described hereinafter.

In addition to the various embodiments described herein, it is to be understood that other similar embodiments can be used or modifications and additions can be made to the described embodiment(s) for performing the same or equivalent function of the corresponding embodiment(s) without deviating there from. Still further, multiple processing chips or multiple devices can share the performance of one or more functions described herein, and similarly, storage can be effected across a plurality of devices. The invention is not to be limited to any single embodiment, but rather can be construed in breadth, spirit and scope in accordance with the appended claims.

What is claimed is:

1. A system facilitating enhancement of confidence in melody matching, comprising:

a memory that stores computer executable components; and a microprocessor that executes the following computer executable components stored in the memory:

a metadata matching component configured to determine a metadata match level between metadata of a plurality of files;

a thresholding component configured to:

compare the metadata match level with a metadata threshold; and output a signal configured to cause a decrease in a melody matching strength threshold from a first value to a second value based at least on the metadata match level being greater than the metadata threshold; and a melody match component that determines a melody match between the plurality of files.

2. The system of claim 1, wherein the melody match is determined based at least on a melody fingerprint computed from respective audio signals associated with the plurality of files.

3. The system of claim 2, wherein the metadata of the plurality of files comprises metadata descriptive of an artist associated with at least one of the audio signals associated with the plurality of files.

4. The system of claim 1, further comprising a melody match strength estimation component configured to determine a strength associated with the melody match.

5. The system of claim 1, wherein the metadata of the plurality of files comprises metadata descriptive of titles of the plurality of files.

6. The system of claim 1, wherein the decrease in the melody matching strength threshold from the first value to the second value is characterized by a step function.

7. The system of claim 1, wherein the decrease in the melody matching strength threshold from the first value to the second value is characterized by a continuous function.

8. The system of claim 1, wherein the plurality of files are media files.

9. The system of claim 1, wherein the first value and the second value are threshold strengths associated with a melody match between the plurality of files.

10. A method, comprising:

employing a microprocessor to execute computer executable components stored within a memory to perform the following:

determining a first metadata match level between metadata of a plurality of video channels;

comparing one or more metadata match levels with a metadata threshold, the one or more metadata match levels comprising the first metadata match level;

decreasing a melody matching strength threshold from a first value to a second value based on at least one of the one or more metadata match levels being greater than the metadata threshold; and determining a melody match between the plurality of video channels.

11. The method of claim 10, wherein the decreasing the melody matching strength threshold from the first value to the second value is characterized by a step function.

12. The method of claim 10, wherein the decreasing the melody matching strength threshold from the first value to the second value is characterized by a continuous function.

13. The method of claim 10, wherein the melody match is determined based at least on a melody fingerprint computed from signals associated with the video channels.

14. The method of claim 10, further comprising determining a melody matching strength associated with the melody match.

15. The method of claim 10, wherein the first value and the second value are threshold strengths associated with a melody match between the plurality of video channels.

16. The method of claim 10, further comprising determining that the melody match is a valid match based at least on the melody matching strength being greater than the second value.

17. A method, comprising;

employing a microprocessor to execute computer executable components stored within a memory to perform the following:

receiving a media file embodying a user performance of a composition;

comparing metadata associated with the media file with metadata associated with a media file embodying a second performance;

determining a metadata match level between the metadata associated with the media file and the metadata associated with the media file embodying the second performance;

determining whether the metadata match level is greater than a metadata threshold;

decreasing a melody matching strength threshold from a first value a second value based at least on the metadata match level being greater than the metadata threshold; and classifying the media file embodying the user performance as a valid melody match with media file embodying the second performance based at least on a strength of matching melodies between the media files being greater than the melody matching strength threshold.

18. The method of claim 17, further comprising:

maintaining the melody matching strength threshold at the first value based, at least, on the metadata match level being less than the metadata threshold.

* * * * *